US005186458A

United States Patent [19]

Redondo

[11] Patent Number: 5,186,458

[45] Date of Patent: Feb. 16, 1993

[54] ILLUMINATED PLAYING BALL

[76] Inventor: Ronald E. Redondo, 2565 "J" Avenue, National City, Calif. 91950

[21] Appl. No.: 780,046

[22] Filed: Oct. 21, 1991

[51] Int. Cl.[5] ..... A63B 43/06

[52] U.S. Cl. ..... 273/65 EF; 273/58 G; 446/485

[58] Field of Search ..... 273/58 R, 58 A, 58 G, 273/65 EF, 213, DIG. 20, DIG. 24, 58 B, 58 BA, 58 K, 60 A; 446/409, 439, 485, 219; 362/32

[56] References Cited

U.S. PATENT DOCUMENTS

| | | | |
|---|---|---|---|
| 2,011,760 | 8/1935 | Gallinant | 273/58 D |
| 2,020,484 | 11/1935 | Turner | 273/58 R |
| 2,903,820 | 9/1959 | Bodell | 273/58 G |
| 3,229,976 | 1/1966 | Allen, Jr. | 273/65 EF |
| 3,458,205 | 7/1969 | Smith et al. | 273/58 G |
| 3,804,411 | 4/1974 | Hendry | 273/58 G |
| 4,002,893 | 1/1977 | Newcomb et al. | 273/58 G |
| 4,133,528 | 1/1979 | Koblick | 273/65 EF |
| 4,840,383 | 6/1989 | Lombardo | 273/DIG. 24 |
| 4,930,776 | 6/1990 | Newcomb et al. | 273/58 G |
| 4,957,297 | 9/1990 | Newcomb et al. | 273/213 |
| 4,979,751 | 12/1990 | Sullivan, III | 273/58 G |
| 5,066,012 | 11/1991 | Stark | 273/586 |

*Primary Examiner*—V. Millin
*Assistant Examiner*—Steven Wong
*Attorney, Agent, or Firm*—Henri J. A. Charmasson

[57] ABSTRACT

A throw ball made of light, translucent material contains an electric bulb or light emitting diode powered by a small battery. The ball is made of two separable, similar half-sections having symmetrical axial tubular cavities housing the electrical assembly. An illuminating switch is activated when the two half-sections are brought together and aligned to a discrete operating position, and de-activated when the two half-sections are rotated away from said operating position.

9 Claims, 5 Drawing Sheets

ILLUMINATED PLAYING BALL

FIELD OF THE INVENTION

This invention relates to toys and more specifically to playing balls.

BACKGROUND OF THE INVENTION

The common game or sporting practice during which a baseball or football is thrown back and forth between two players alternately acting as pitcher and catcher or quarterback and receiver can only be practiced during daylight, or at night in a lighted area.

Accordingly, it would be advantageous to have a throw-ball which is illuminated so that the above-described game or practice would not have to be interrupted at dusk, but could be practiced anywhere, on beaches, backyards and sporting fields at any time of the night in the absence of outdoor lighting.

SUMMARY OF THE INVENTION

The principal and secondary objects of this invention are to provide a playball that retains the main characteristic of a baseball or softball, is well balanced but contains an illuminating assembly which can be activated when the ball is used in a dark environment.

These and other objects are achieved by a ball made of light, translucent material which contains a light emitting material powered by a small battery. The ball is made of two separable similar half-sections having symmetrical axial tubular cavities housing electrical components. In one embodiment of the invention fiber optics are used to bring light from the interior of the ball to a plurality of meridian strips. The structure can also be used as a light, illuminated marker or as an ornament.

DESCRIPTION OF THE PREFERRED EMBODIMENTS OF THE INVENTION

Figure 1:
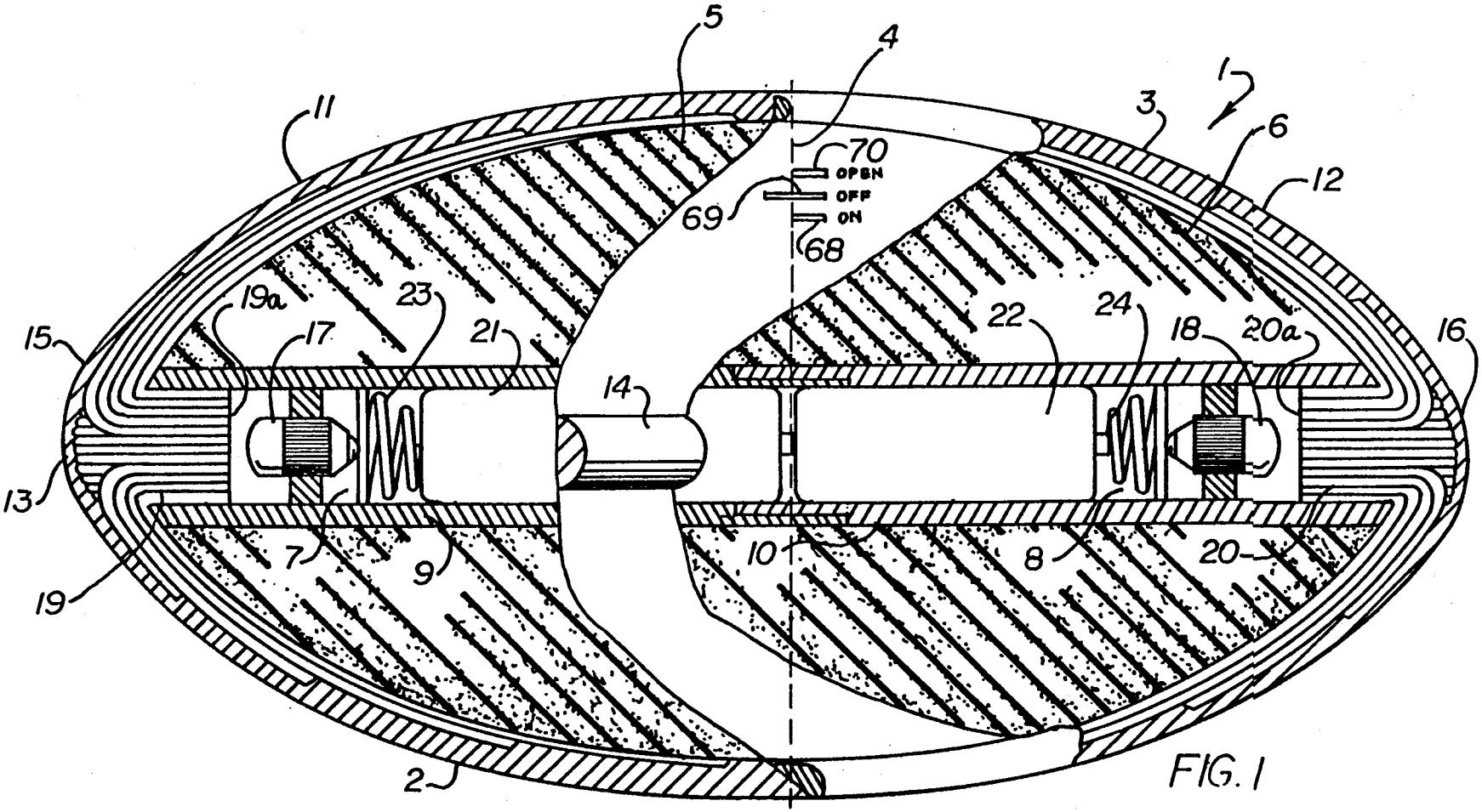
FIG. 1 is a side elevational view of a football according to the invention with cut-outs exposing the electrical assembly.

Referring now to the drawing, there is shown in FIG. 1 a first embodiment of the invention 1 having the general shape and size of a football. The ball comprises two symmetrical half-sections 2, 3 joined together about an equatorial line 4. The core 5, 6 of each section is preferably made of a resilient material such as a synthetic foam. Each core has an axial, tubular cavity 7, 8 throughout. Each cavity is lined with a tubular sleeve 9, 10. Each half section 2 is capped by a pair of strips 11, 12 and 13, 14 meridionally oriented and orthogonally intercepting each other at the apexes 15, 16. The strips are made of a soft translucent material such as silicone or soft plastic. A light-emitting element 17, 18 such as a light bulb or light-emitting diode is axially mounted into each half-section of the tubular sleeve 9, 10, and directed toward the apex 15, 16. A bundle of fiber optics conductors 19, 20 have extremities **19*a* and 20*a* closely exposed to the light-emitting element. The fiber optic conductors 19 penetrate the meridional strips 11, 12 and 13, 14 about the apexes and spread into four separate bundles running within the strips, and terminating at different spaced-apart intervals within said strips. A pair of serially mounted batteries 21, 22 occupy the central portion of the tubular sleeves and contact the light-emitting elements 17, 18 through spiral springs 23, 24**.

Figure 2:
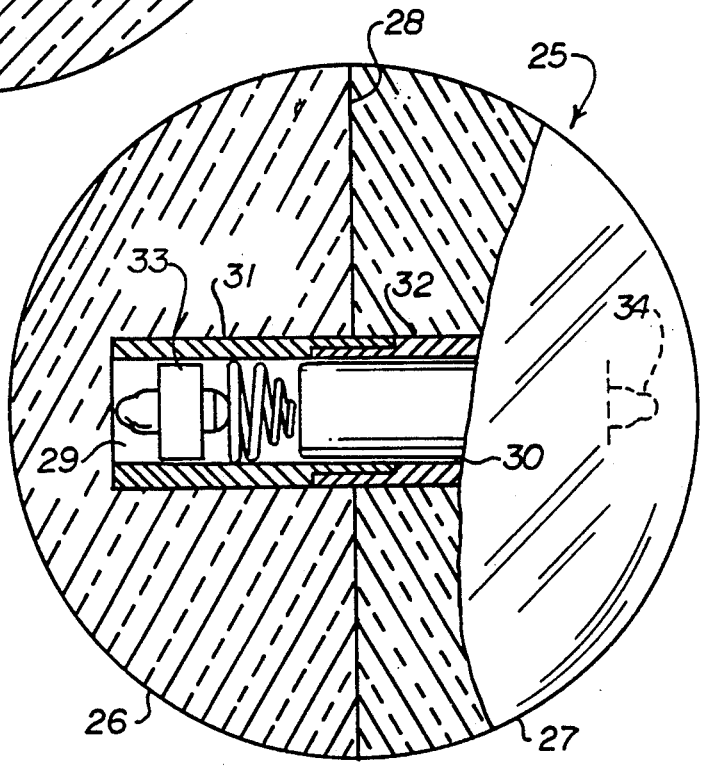
FIG. 2 is an elevational view of a baseball according to the invention with a cut-out exposing the electrical assembly.
Figure 3:
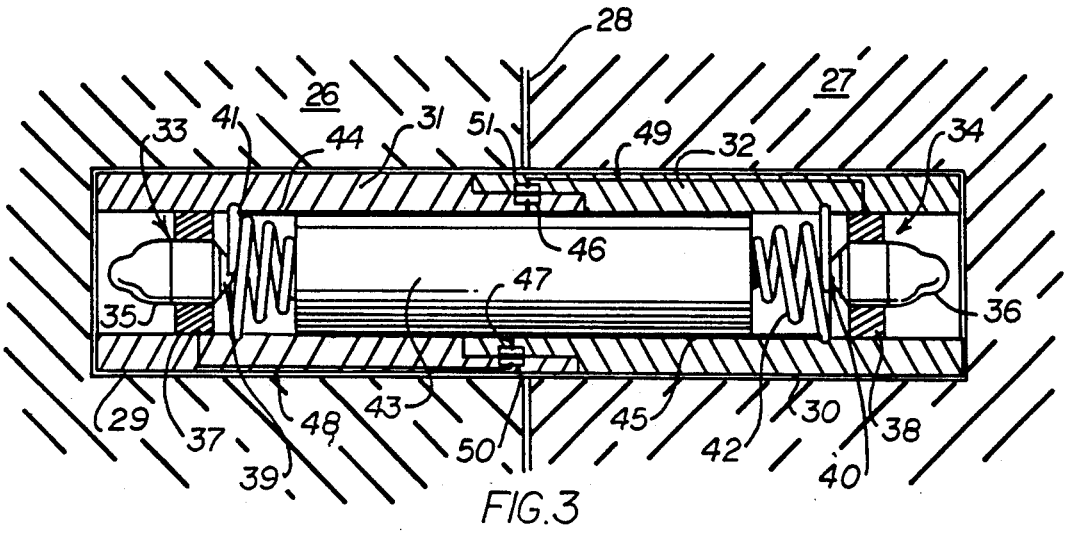
FIG. 3 is a detail view of the electrical assembly.

FIG. 2 illustrates a second embodiment 25 of the invention in the shape and size of a baseball. As in the first embodiment, the ball comprises two symmetrical half-portions 26, 27 joined along an equatorial plane 28. The entire ball is made of an homogeneous, resilient and translucent material such as silicone or a soft plastic. Each half-section has an axial, tubular cavity 29, 30 which extends from the equatorial plane 28 to approximately three-quarters of the radius. Each cavity is lined with a tubular sleeve 31, 32 preferably made of transparent material. As in the prior embodiment, each sleeve incorporates a light assembly 33, 34 which is more specifically illustrated in FIG. 3.

Figure 4:
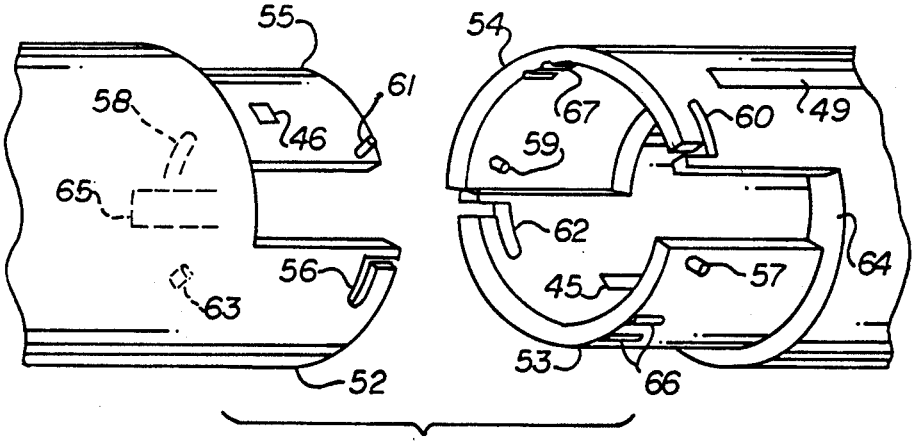
FIG. 4 is a detail view of the ball sections interlocking structure.

The two half-sections of the transparent sleeves 31, 32 are joined together at the equatorial plane 28 in an overlapping arrangement more specifically illustrated in FIG. 4. Each light assembly 33, 34 comprises a bulb or light-emitting diode 35, 36 coaxially mounted in a metallic bushing 37, 38. The back terminal 39, 40 of each bulb or diode is in contact with a spiral spring 41, 42 that also contacts one terminal of a central battery 43. An electrical conductor 44 runs from each spring 41, 42 to a terminal 46, 47 in the overlapping portion of the sleeve junction. Another conductor 48, 49 runs from the bulb mounting bushing 37, 38 to a terminal 50, 51 that is in mating contact with the first terminal 46, 47 of the opposite section. It can thus be understood that when each pair of terminals in opposite sections of the sleeve are in contact, each light assembly is placed in contact with one terminal of the battery through the mounting bushing, and in contact with the opposite terminal of the battery through the spiral spring.

As illustrated in FIG. 4, the interconnecting central extremities of each half-sections of tubular sleeve form two semi-circular and coaxial overlapping surfaces 52, 53 and 54, 55 carrying bayonet-type interlocking elements 56, 57, 58, 59, 60, 61, 62, 63. The hemispheric elements 52 and 55 and 53 and 54 are separated by gaps 64, 65 which allow enough rotational movement to establish or break contact between terminals 46, 51 and 47, 50 without disengagement of the bayonet-type interconnections. This interconnecting structure is common to both embodiments 1, 2, and the only difference in the electrical assemblies of the two embodiments are the two batteries in the first embodiment instead of the single battery in the second embodiment.

In both embodiments, two discrete radial positions at which the two half-sections remain joined by the bayonet-type interconnections are established by two pairs of diametrically opposed nibs 66 and matching depressions 67 along the peripheral planes 4. Accordingly, once the two halves of the ball have been brought together and the bayonet-type interconnections have been made, the relative rotational position of the two half-sections can be positively moved from one where electrical contact is established to one where the electrical contact has been broken. These ON and OFF relative positions of the two halves as well as the releasing positions are indicated by index marks 68, 69, 70 on the ball surface, along the equatorial lines 4, 28.

It should be noted that each half of each embodiment is exactly similar and symmetrical to the other in every respect. This feature not only properly balances the throw-ball but also simplifies the manufacturing, as well as the mounting of the batteries which can be oriented in any direction.

Figure 5:
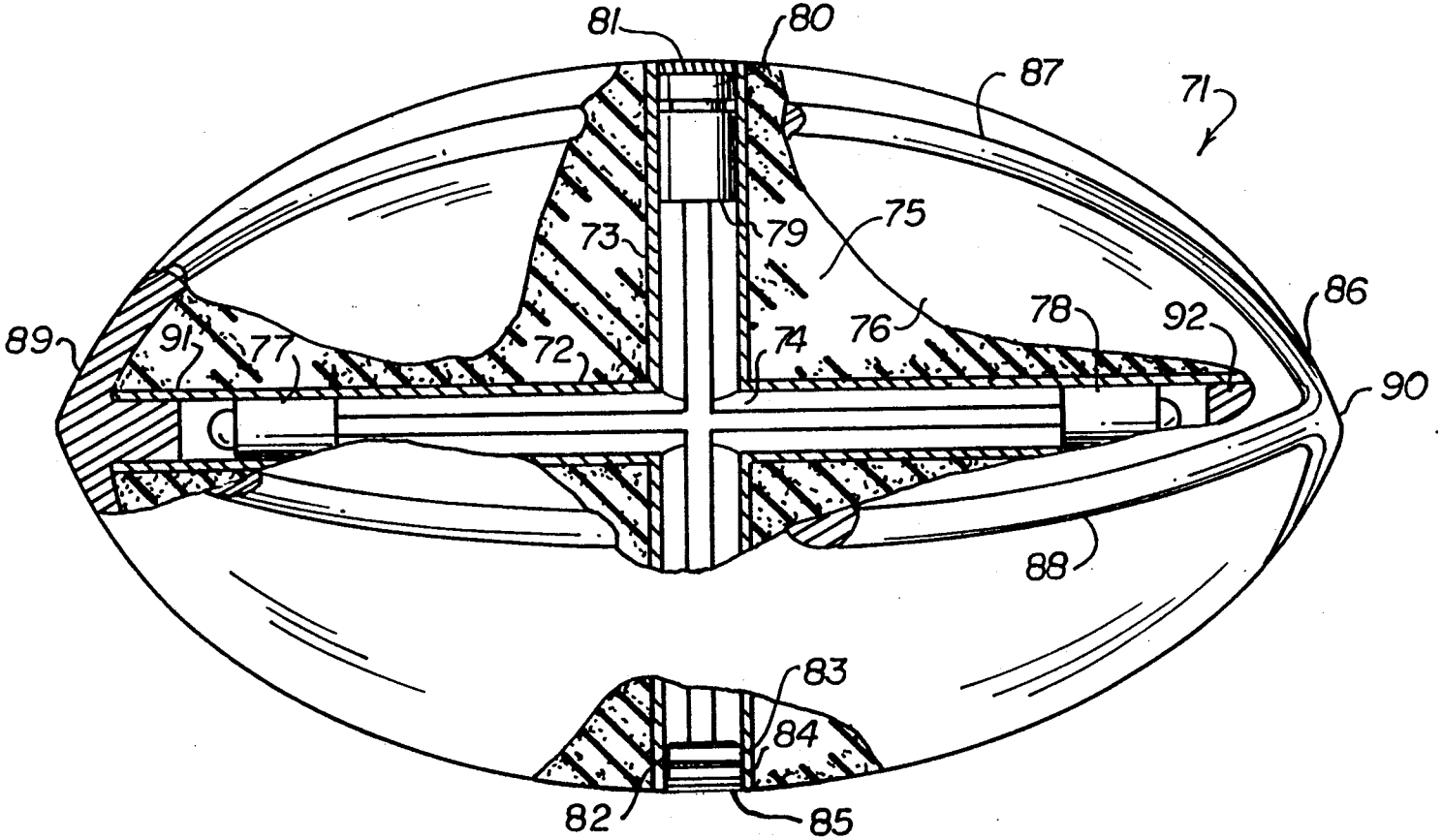
FIG. 5 is a cross-sectional view of an alternate embodiment of the football.

An alternate embodiment 71 of the football is illustrated in FIG. 5. This alternate embodiment is characterized by an armature made of two lengths of tubular conduit 72, 73 orthogonally intercepting each other in their middle 74. The conduits are embedded in the center of a football body 75 made of resilient material such as synthetic foam. The entire ball is covered by a thin skin 76 bonded to the core material. The longest diameter conduit 72 houses two back-to-back light-emitting elements 77, 78. The short diameter conduit 73 houses a pushbutton switch 79 with its button 80 positioned just under the section 81 of skin closing one end of the conduit. The opposite end of the short diameter conduit 73 has a covered housing 82 for a pair of lithium batteries 83, 84. The screw-on housing cover 85 is flush with the lower surface of the ball-skin 76. Appropriate wiring connects the light-emitting elements 77, 78 with the batteries through the switch 79.

Figure 6:
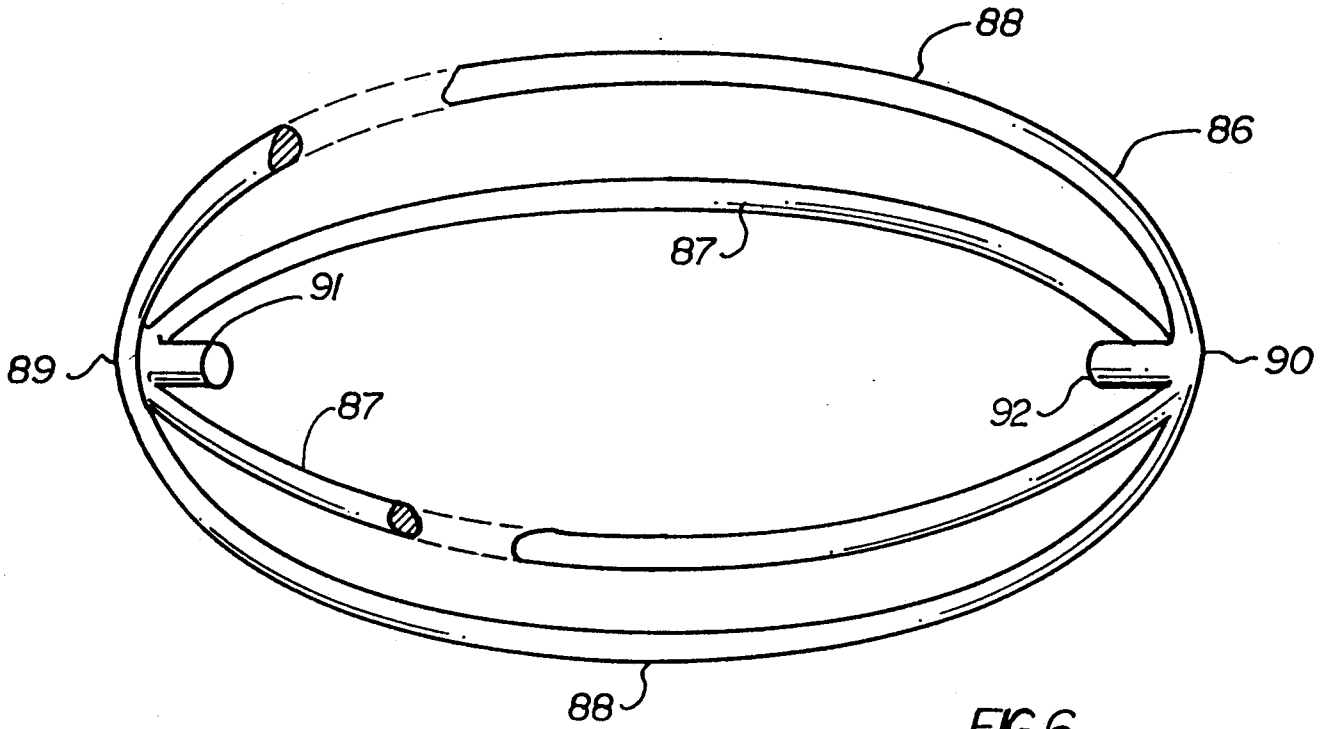
FIG. 6 is a perspective view of the illuminated rib cage.

A cage 86 illustrated in FIG. 6, made from a resilient, translucent material is stretched over the entire ball. The cage consists of two meridian ribs 87, 88 connected as right angles at the two apexes 89, 90 of the ball. From the apex portions of the cage, a pair of plugs 91, 92 extend toward the light-emitting elements 77, 78. Thus, when the lights are energized the entire cage 86 becomes luminescent.

Figure 7:
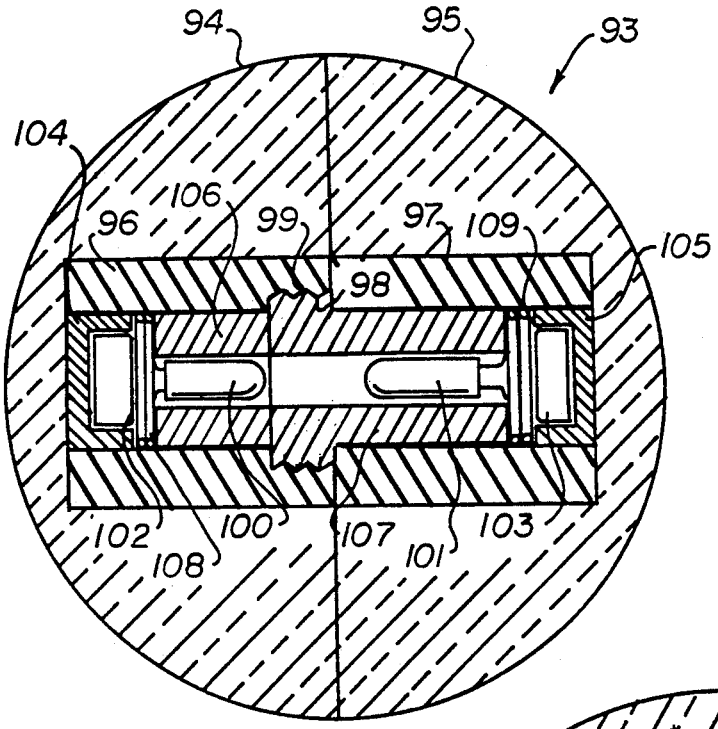
FIG. 7 is a cross-sectional view of an alternate embodiment of the baseball.
Figure 8:
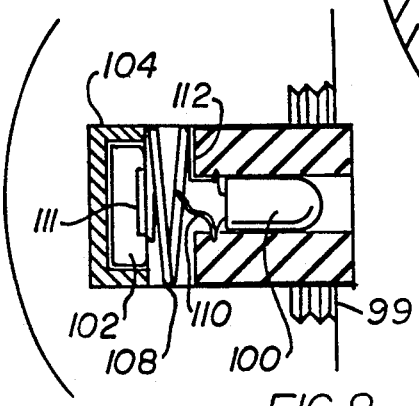
FIG. 8 is a cross-sectional view of a light assembly.

An alternate embodiment 93 of the baseball is illustrated in FIG. 7. It comprises two hemispherical elements 94, 95 made of a resilient, translucent material such as silicone or plastic. The elements are transversed by axial cavities lined with two mating lengths of transparent tubular conduit 96, 97. The two tubular conduits connect in the center of the ball by threaded male and female couplings 98, 99. Each half houses a light-emitting element 100, 101. Each light-emitting element is powered by a lithium battery 102, 103 mounted in a battery housing 104, 105 which occupies the closed end of the tubular conduit 96, 97. The light-emitting elements are mounted in transparent lengths of tubing 106, 107 that are slidingly and coaxially engaged in the tubular conduits 96, 97. As long as the two halves 94, 95 of the ball remain tightly screwed together, the light-emitting elements contact the batteries and are energized. When the halves are unscrewed the lengths of tubing 106, 107 are pushed away from the battery housing 104, 105 by coil springs 108, 109 as illustrated in FIG. 8. The leaf-spring terminal 110 associated with one of the light-emitter lead loses contact with the positive pole 111 at the center of the battery. Only the peripheral terminal 112 connected with the other light-emitter lead remains in loose contact with the battery housing, i.e., the negative pole of the battery through the coil spring 108.

While the preferred embodiments of the invention have been described, modifications can be made and other embodiments may be devised without departing from the spirit of the invention and the scope of the appended claims.

What is claimed is:

1. An illuminated ball which comprises:

a rounded body made of resilient material, said body having a transversal tubular cavity;

at least one light-emitting element mounted into said cavity;

an electrical battery;

releasable means for electrically connecting said light-emitting element to said battery;

a first strip of translucent material meridionally mounted around the periphery of said body;

said strip comprising a projection engaged into said cavity, said projection having a end exposed to said light-emitting element a length of transparent tubular sleeve lining said cavity;

a second strip of translucent material meridionally mounted around the periphery of said body, said second strip merging integrally with said first strip at two opposite poles of said body to form a rib cage; wherein said tubular sleeve has opposite openings at said poles; and one of said openings is engaged by said projection.

2. The ball of claim 1, wherein said resilient body comprises two symmetrical half-sections joined about an equatorial plane.

3. The ball of claim 2, wherein said tubular sleeve comprises two half-parts having mating interconnection at said equatorial plane.

4. The ball of claim 3, wherein said means for electrically connecting comprises electrical terminals located on each of said half-parts, said electrical terminals being shaped and positioned to come into contact upon axial movement of each of said half-parts toward the other.

5. The ball of claim 1, wherein each of said strips comprises a plurality of fiber optic conduits embedded into said strip, wherein each of said conduits has one extremity in said portion proximal to said light-emitting element.

6. The ball of claim 1, wherein said resilient material is translucent.

7. The ball of claim 6, wherein said resilient body comprises two symmetrical half-sections joined about an equatorial plane.

8. The ball of claim 7, wherein said tubular sleeve comprises tow half-parts having mating interconnection at said equatorial plane.

9. The ball of claim 8, wherein means for electrically connecting comprises electrical terminals located on each of said half-parts, said electrical terminals being shaped and positioned to come into contact upon axial movement of each of said half-parts toward the other.

* * * * *